US008899686B1

(12) United States Patent
Kim

(10) Patent No.: US 8,899,686 B1
(45) Date of Patent: Dec. 2, 2014

(54) COLLAPSIBLE CHAIR FOR LEISURE

(71) Applicant: Osung Duralumin Co., Ltd., Incheon (KR)

(72) Inventor: Hyun-Gil Kim, Goyang-si (KR)

(73) Assignee: Osung Duralumin Co., Ltd., Incheon (KR)

( * ) Notice: Subject to any disclaimer, the term of this patent is extended or adjusted under 35 U.S.C. 154(b) by 0 days.

(21) Appl. No.: 14/285,609

(22) Filed: May 22, 2014

(30) Foreign Application Priority Data

Jun. 19, 2013 (KR) ..... 10-2013-0070285

(51) Int. Cl.
*A47C 4/28* (2006.01)
*A47C 4/02* (2006.01)

(52) U.S. Cl.
CPC ..... *A47C 4/021* (2013.01)
USPC ..... 297/440.11; 297/16.1

(58) Field of Classification Search
CPC ..... A47C 9/10; A47C 9/105; A47C 4/28; A47C 4/283; A47C 4/286
USPC ..... 297/440.11, 16.1, 16.2, 17
See application file for complete search history.

(56) References Cited

U.S. PATENT DOCUMENTS 4,605,261 A * 8/1986 Lee ..... 297/16.2
5,362,130 A * 11/1994 Hoffman ..... 297/440.11
8,454,084 B2 * 6/2013 Lah ..... 297/16.2
2007/0252416 A1 * 11/2007 Park et al. ..... 297/16.2
2013/0069397 A1 3/2013 Homans

FOREIGN PATENT DOCUMENTS

JP 11164752 A 6/1999
KR 20010074621 A 8/2001
KR 1020120044577 B1 8/2012

OTHER PUBLICATIONS

Korean Notice of Allowance dated Jul. 11, 2013 for application No. 10-2013-0070285, citing the above reference(s).

* cited by examiner

*Primary Examiner* — Sarah B McPartlin
(74) *Attorney, Agent, or Firm* — Lowe Hauptman & Ham, LLP

(57) ABSTRACT

Disclosed is a collapsible chair including a cylindrical main body 101 which is a major component of a collapsible chair, front and rear support poles 111 and 131 which support the main body 101 at a predetermined angle on front and rear side, respectively, seat back poles 121 and seat support poles 141 which are connected to the main body 101 to extend forward and upward, and a seat 151 whose opposite end portions are fixed by the seat back poles 121 and the seat support poles 141. The main body 101 has coupling holes 102 formed on opposite end portions thereof at a predetermined angle, first insertion holes 103 formed on opposite end portions thereof at a predetermined angle and an interval with the coupling hole 102.

5 Claims, 5 Drawing Sheets

COLLAPSIBLE CHAIR FOR LEISURE

RELATED APPLICATIONS

This application claims priority to Korean Patent Application No. 10-2013-0070285, filed on Jun. 19, 2013 in the Korean Intellectual Property Office, the entire disclosure of which is incorporated herein by reference.

BACKGROUND OF THE INVENTION

1. Field of the Invention

The present invention relates to a collapsible chair for leisure, and more specifically to a collapsible chair which includes a main body provided with coupling holes, first and second insertion holes which are formed on opposite end portions thereof at predetermined angles different from each other; front support poles whose one end is inserted into the coupling hole of the main body through a telescopic insert part housed therein and the other end thereof is supported on ground; rear support pole whose one end is inserted into the first insertion hole of the main body through a telescopic insert part housed therein and the other end thereof is supported on the ground; seat support poles whose one end is inserted into the second insertion hole of the main body through a telescopic insert part housed therein; seat back poles whose one end is connected to the insert part of the front support pole; and a seat having insert parts formed at four corners so that the other ends of the seat support poles and the seat back poles are inserted respectively. In particular, the present invention relates to a collapsible chair for leisure, which can be easily installed and folded in the field by using the main body having the coupling holes, and first and second insertion holes, and the front and rear support poles, seat back poles and seat support poles which inserted separately into these holes; which can save resources, has no risk of breakdown, and can be made lightweight; and has a simple configuration that has no need of additional connecting member, whereby can provide relaxed and comfortable seating sensation; since the load transmitted to the seat back pole through the seat by the bent portion formed on the seat back pole is supported flexibly; which can enhance safety by preventing the top of the seat from being folded as both seat back poles are retracted inward on sitting on the seat by the headrest embedded in the upper end portion of the seat; and which improves convenience by providing the headrest function.

2. Description of the Related Art

Due to the development of the leisure industry and the increase in outdoor activity, the demand for portable chairs that can be carried conveniently is increasing. As an example of the art, there is a "portable chair" disclosed in Korea Patent Registration No. 10-1176740 issued to the present applicant.

The portable chair of the above patent is provided with hubs installed respectively on both of the left and right sides of the chair; a center support frame connecting both of the left and right hubs; front and rear leg frames having footing end portions separately coupled respectively on the front and rear peripheral sides below the hub and front and rear leg frames having free end portions disposed in a radially extending form toward ground; front and rear pole frames having footing end portions separately coupled to the front and rear peripheral sides above respective hubs and free end portions disposed in a radially extending form toward the sky; and a seat coupled to the free ends of the front and rear pole frames. The front and rear leg frames have lengths shorter than the front pole frame and the rear pole frame, and one or more frames of the front pole frame and the rear pole frame have two or more unit pole frames connected longitudinally.

However, the portable chair having the above-described configuration has a large number of components since it is provided with hubs installed on both sides of the support frame, a plurality of holes formed in the hubs, and front and rear pole frames and front and rear leg frames inserted into these holes.

Due to such an increase of the number of components, the number of manufacturing processes and costs increases, resources are wasted, and the weight of the chair increases, thereby a lightweight chair for leisure cannot be achieved.

Further, because two frames forming the rear pole frames connected to both hubs are connected on a straight line in a portable chair in the prior art, when the back is leaned against the seat after sitting, the load is concentrated in the direction of the rear pole frame. Due to that, the chair tumbles back frequently, and caution must be taken for safety while using it.

In addition, the chair in the art cannot prop up the head stably because the rear pole frame connected to both hubs is retracted inward to make the top of the seat folded when the user leans the back against the seat after he or she sits on the seat.

SUMMARY OF THE INVENTION

In consideration of the above-mentioned circumstances, it is an object of the present invention to provide a collapsible chair which includes coupling holes, first and second insertion holes which formed on opposite end portions of a main body at predetermined angles different from each other; and front and rear support poles which have telescopic insert parts and are inserted into the coupling holes and first insertion holes, respectively; seat support poles which have telescopic insert parts and are inserted into the second insertion holes; seat back poles which are connected to the insert poles of the front support poles; and a seat having insert parts formed at top and bottom corners to be inserted the seat support poles and the seat back poles, respectively, thereby it is possible to be easily installed and folded in the field by using the coupling holes, first insertion holes and second insertion holes, and the front and rear support poles, seat back poles and seat support poles which are separately inserted into these holes, to save resources, have no risk of breakdown with lightweight, have a simple configuration that has no need of additional connecting member, to provide relaxed and comfortable seating sensation, and since the load transmitted to the seat back pole through the seat is absorbed by the bent portion formed on the seat back pole; thereby enhancing safety by preventing the top of the seat from being folded as both seat back poles are retracted inward on sitting on the seat by the headrest embedded in the upper end portion of the seat, and improving convenience by providing the headrest function.

In order to accomplish the above objects of the present invention, there is provided a collapsible chair for leisure including: a main body which has coupling holes formed on opposite end portions thereof at a predetermined angle, first insertion holes formed on opposite end portions thereof at a predetermined angle and an interval with the coupling hole, and second insertion holes formed on opposite end portions thereof at a predetermined angle and an interval with the first insertion hole; front support poles whose one end is inserted into the coupling hole of the main body through a telescopic insert part housed therein and the other end thereof is supported on ground; seat back pole whose one end is connected to the insert part of the front support pole; rear support pole whose one end is inserted into the first insertion hole of the main body through a telescopic insert part housed therein and the other end thereof is supported on the ground; seat support poles whose one end is inserted into the second insertion hole of the main body through a telescopic insert part housed therein on a side opposite to the rear support pole; and a seat whose opposite end portions are fixed by the other ends of the seat back pole and the seat support pole through insert parts formed at four corners thereof.

Preferably, the seat back pole has a bent portion formed in a middle section thereof adjacent to the main body at a predetermined angle so as to absorb a load of a user applied to the seat back pole through the seat.

Preferably, the seat has a headrest which is embedded in the upper end portion thereof adjacent to a tip end of the seat back pole so as to prevent the top of the seat from being folded as both seat back poles are retracted inward by the load of the user sitting on the seat.

Preferably, the front support pole and the seat back pole are connected with each other by an elastic cable inserted in the coupling hole of the main body, and the rear support pole and the seat support pole are connected with each other by an elastic cable sequentially inserted in the first and second insertion holes of the main body.

In addition, the collapsible chair for leisure further includes a first cap configured to connect with the insert part of the rear support pole which is inserted in the first insertion hole of the main body by the elastic cable; and a second cap configured to connect with the insert part of the seat support pole which is inserted in the second insertion hole of the main body by the elastic cable.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Hereinafter, preferred embodiments of the present invention will be described in detail with reference to the accompanying drawings.

Figure 1:
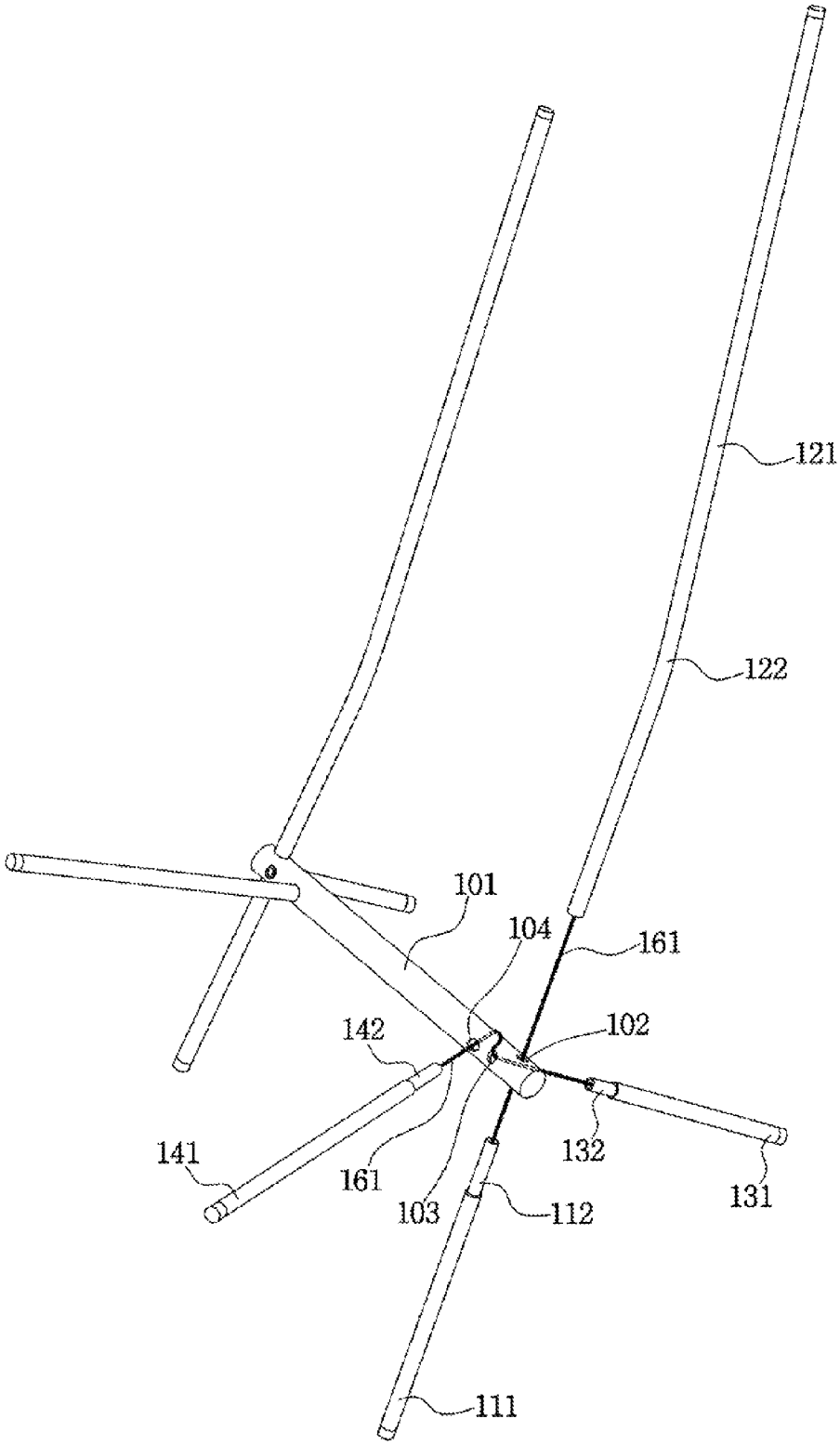
FIG. 1 is a perspective view illustrating each component of a collapsible chair according to one embodiment of the present invention, in which a part there of is separated for describing the configuration of a frame of the chair.
Figure 2:
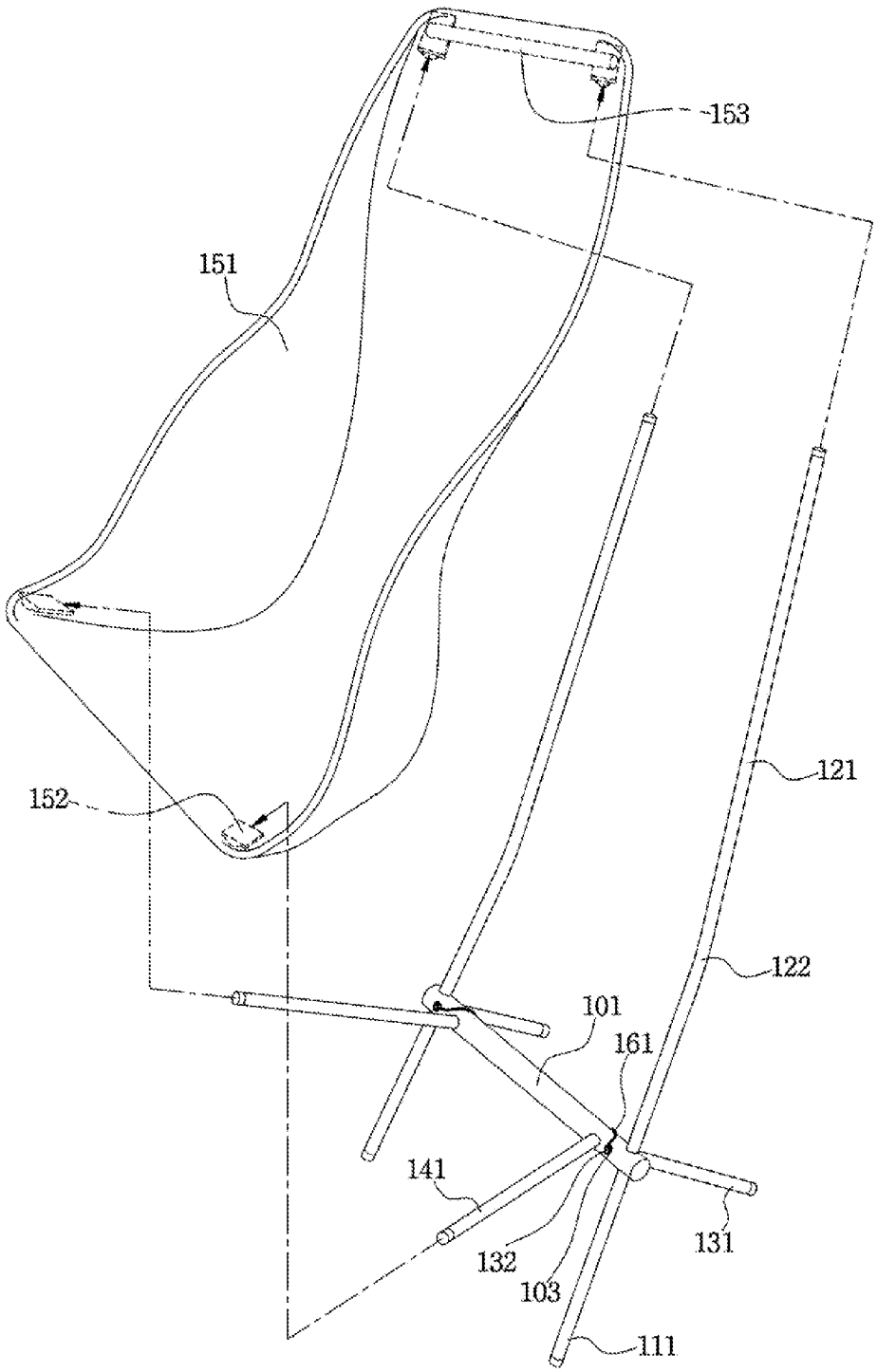
FIG. 2 is a perspective view illustrating a state in which a seat is coupled to the frame of the collapsible chair according to the present invention.
Figure 3:
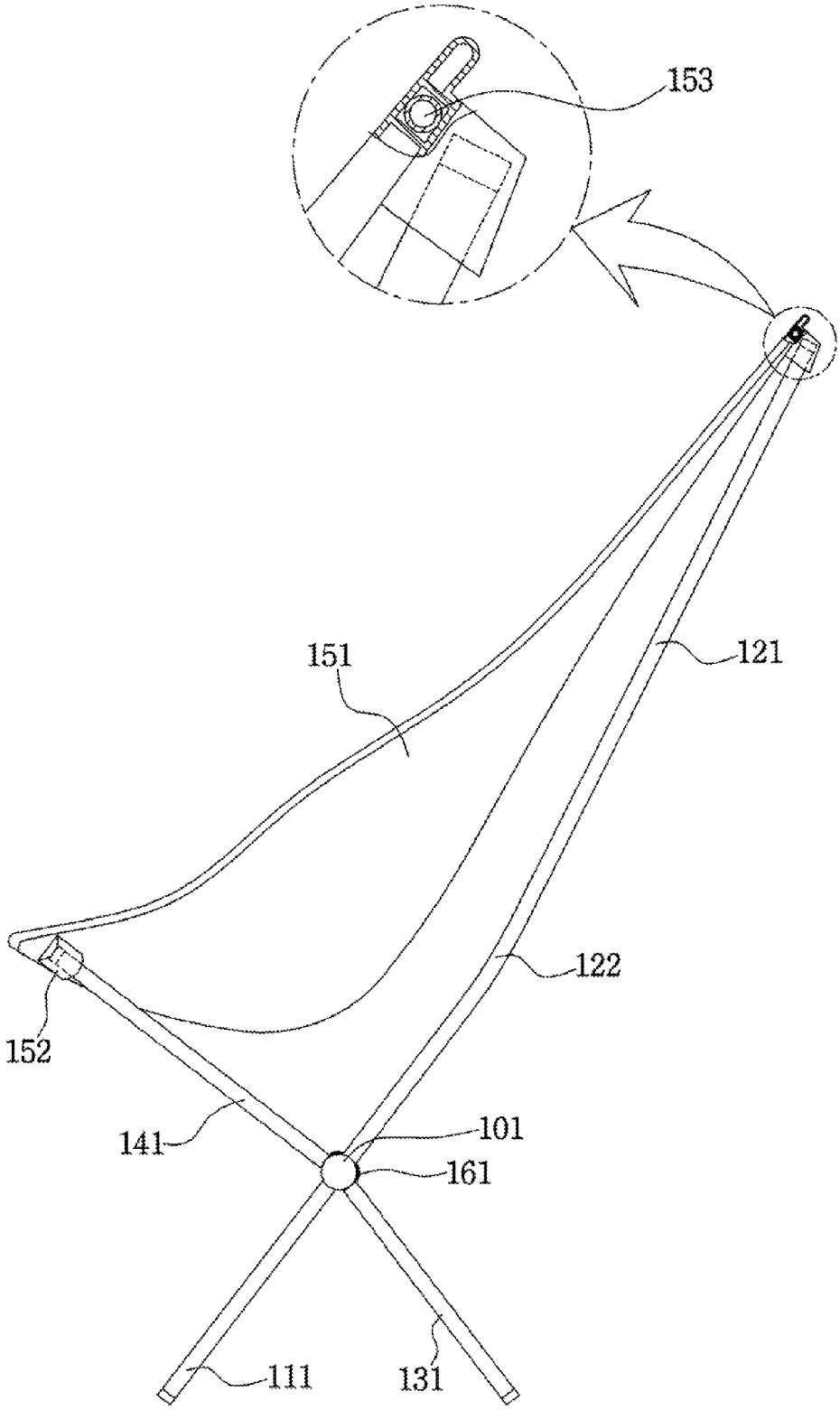
FIG. 3 is a side view illustrating the collapsible chair according to the present invention, wherein a headrest embedded in the seat is partially cut away for illustration.

FIG. 1 is a perspective view illustrating each component of a collapsible chair according to one embodiment of the present invention, in which a part there of is separated for describing the configuration of a frame of the chair, FIG. 2 is a perspective view illustrating a state in which a seat is coupled to the frame of the collapsible chair according to the present invention, and FIG. 3 is a side view illustrating the collapsible chair according to the present invention, wherein a headrest embedded in the seat is partially cut away for illustration.

As shown in FIGS. 1 to 3, the collapsible chair according to one embodiment of the present invention generally includes a cylindrical main body 101 which is a major component of the chair, front and rear support poles 111 and 131 which support the main body 101 at a predetermined angle on front and rear side, respectively, seat back poles 121 and seat support poles 141 which are connected to the main body 101 with a predetermined angle, and a seat 151 whose opposite end portions are fixed by the seat back poles 121 and the seat support poles 141.

The main body 101 has coupling holes 102 formed on opposite end portions thereof at a predetermined angle, first insertion holes 103 formed on opposite end portions thereof at a predetermined angle and an interval with the coupling hole 102, and second insertion holes 104 formed on opposite end portions thereof at a predetermined angle and an interval with the first insertion hole 103.

The front support pole 111 has a telescopic insert part 112 which is housed therein to be inserted into the coupling hole 102 of the main body 101 from a front side. When assembling, one end (that is, upper end) of the front support poles 111 is inserted into the coupling hole 102 of the main body 101 through the insert part 112 and the other end thereof is supported on ground to support the main body 101 on the front side.

One end (that is, lower end) of the seat back pole 121 is connected to the insert part 112 of the front support pole 111, and the other end thereof is inserted into an insertion pocket 152 which is formed on upper rear surface of the seat 151. In use, the seat back poles 121 are disposed to be opposed to the front support poles 111 around the main body 101 in a longitudinal direction.

The rear support poles 131 has a telescopic insert part 132 which is housed therein to be inserted into the first insertion hole 103 of the main body 101 from a rear side. One end (that is, upper end) of the rear support poles 131 is inserted into the first insertion hole 103 of the main body 101 through the insert part 132 and the other end thereof is supported on the ground to support the main body 101 at a predetermined angle with the front support poles 111.

The seat support pole 141 has a telescopic insert part 142 which is housed therein to be inserted into the second insertion holes 104 of the main body 101. One end (that is, upper end) of the seat support poles 141 is inserted into the second insertion hole 104 of the main body 101 through the insert part 142 on a side opposite to the rear support pole, and the other end thereof is inserted into the insertion pocket 152 which is formed on lower rear surface of the seat 151. In use, the seat support poles 141 are disposed to be opposed to the rear support poles 131 around the main body 101 at a predetermined angle.

As described above, a lower end portion of the seat 151 is fixed to a tip end of the seat support poles 141 inserted in the second insertion holes 104 through the insertion pocket 152, and an upper end portion thereof is fixed to the tip end of the seat back poles 121 connected to the insert part 112 of the front support pole 111 through the insertion pocket 152, so as to form a seat portion and seat back portion of the chair.

Herein, the seat back pole 121 has a bent portion 122 formed in a middle section thereof adjacent to the main body 101 at a predetermined angle. Therefore, the seat back poles 121 may elastically support the back of the user so as to absorb a load of a user applied to the seat back pole 121 through the seat 151.

The seat 151 has a headrest 153 which is embedded in the upper end portion thereof adjacent to a tip end of the seat back pole 121. Therefore, when the user sits on the seat 151, it is possible to prevent the top of the seat 151 from being folded as both seat back poles 121 are retracted inward by the load of the user sitting on the seat 151.

The front support pole 111 and the seat back pole 121 are connected with each other by an elastic cable 161 inserted in the coupling hole 102 of the main body 101, and the rear support pole 131 and the seat support pole 141 are connected with each other by an elastic cable 161 sequentially inserted in the first and second insertion holes 103 and 104 of the main body 101.

Next, an operation of the collapsible chair of the present invention having the above-described configuration will be described in detail.

In the collapsible chair according to the present invention, as shown in FIG. 1, the insert part 112 of the front support pole 111 is inserted into the coupling hole 102 of the main body 101, while the front support pole 111 and the seat back pole 121 are connected with each other by the elastic cable 161. In addition, the lower end of the seat back pole 121 is connected to the insert part 112 of the front support pole 111.

Further, the insert part 142 of the seat support pole 141 is inserted into the second insertion hole 104 of the main body 101, and the insert part 132 of the rear support poles 131 is inserted into the first insertion hole 103 of the main body 101, while the rear support pole 131 and the seat support pole 141 are connected with each other through the elastic cable 161.

Accordingly, the user may easily install and fold the collapsible chair by inserting and removing the plurality poles which are connected with each other by the elastic cables 161 into and from the plurality insertion holes 102, 103 and 104 which are formed on the main body 101. In addition, the collapsible chair employs the seat 151 capable of being folded in a small size, the user may easily carry and store the collapsible chair.

To use the collapsible chair of the present invention in the field, first, the insert parts 112 extending from the front support poles 111 are inserted into the coupling holes 102 formed on opposite end portions of the main body 101 at the predetermined angle to expose the upper end portions thereof from the coupling holes 102.

Then, the lower end of the seat back poles 121 is connected to the insert part 112 of the front support poles 111 exposed from the coupling holes 102.

Next, the insert parts 132 of the rear support poles 131 are inserted into the first insertion holes 103 formed on opposite end portions of the main body 101 at a predetermined angle and interval with the coupling holes 102, and then the insert parts 142 of the seat support poles 141 are inserted into the second insertion holes 104 formed on the opposite end portions of the main body 101 at a predetermined angle and interval with the first insertion holes 103. Thereby, the frame of the collapsible chair is formed by the plurality of poles 111, 121, 131 and 141 which are connected to the main body 101.

As described above, when one ends of the front support poles 111 are inserted into the coupling holes 102 of the main body 101 and connected with the lower end of the seat back poles 121, and then one ends of rear support poles 131 and the seat support poles 141 are inserted into the first insertion holes 103 and the second insertion holes 104 of the main body 101, respectively, these poles 111, 121, 131 and 141 may be maintained in a tightly connected with each other by the elastic cables 161. Thereby, it is possible to prevent these poles 111, 121, 131 and 141 from being separated from each other in use.

When the frame of the collapsible chair is formed by the above-described process, as shown in FIG. 2, each of the tip ends of the seat support poles 141 and the seat back poles 121 is coupled to the upper and lower corners of the seat 151. That is, each of the tip ends of the seat support poles 141 and the seat back poles 121 is inserted into the plurality of the insertion pocket 152 attached on the opposite end portions of the seat 151, thereby a complete collapsible chair is prepared, as shown in FIG. 3.

In the collapsible chair according to the present invention, the coupling holes 102, the first and second insertion holes 103 and 104 are formed on the opposite end portions of the main body 101 at the predetermined angles different from each other, and the front and rear support poles 111 and 131, the seat back poles 121 and the seat support poles 141 are inserted therein and separated therefrom, it is possible to easily and quickly install and fold the chair in the field.

In addition, since the coupling holes 102, the first and second insertion holes 103 and 104 are formed on the opposite end portions of one main body 101 at the predetermined angles different from each other, it is unnecessary an additional member for connecting the poles with the main body, and thereby it is possible to provide the collapsible chair with a simple configuration.

When the user sitting on the seat portion of the seat 151 leaned back in the seat back of the seat 151, the load of the user is applied to the seat back poles 121 through the seat 151. At this time, since the seat back poles 121 has the bent portion 122 which is formed in the middle section thereof at a predetermined angle, the load of the user is absorbed by the bent portion 122 of the seat back poles 121, while elastically support the back of the user. Thereby, it is possible to provide a seating sensation with relaxed and improved comfortableness.

Further, when the user sitting on the seat portion of the seat 151, the bent portion 122 supporting both sides of the seat 151 may be retracted inward. In order to prevent this retraction, the collapsible chair of the present invention has the headrest 153 which is embedded in the upper end portion of the seat 151. Therefore, retraction of the upper end portion of the seat 151 may be prevented by the headrest 153, and thereby providing the headrest effect to the user with improved and relaxed seating sensation.

Figure 4:
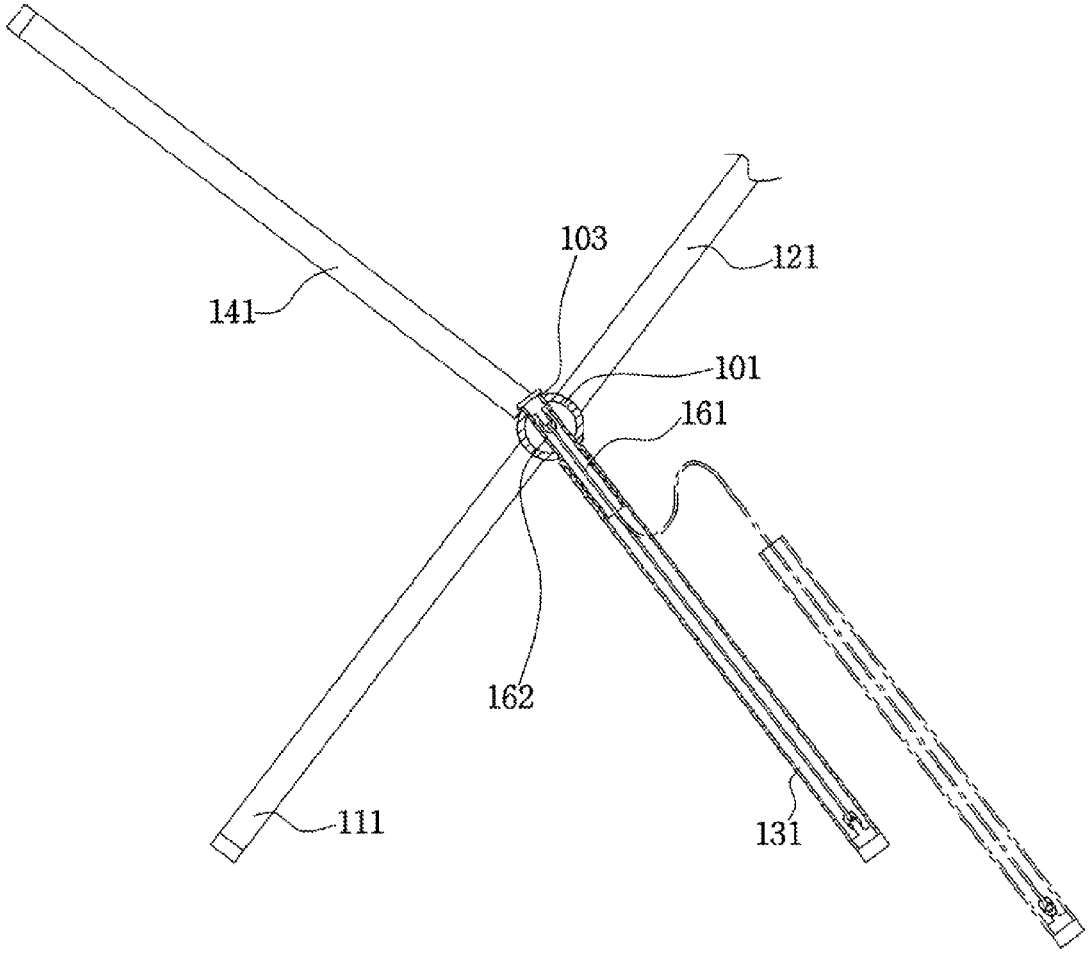
FIG. 4 is a partial cross-sectional view showing a coupled state of a rear support pole of a collapsible chair according to another embodiment of the present invention.
Figure 5:
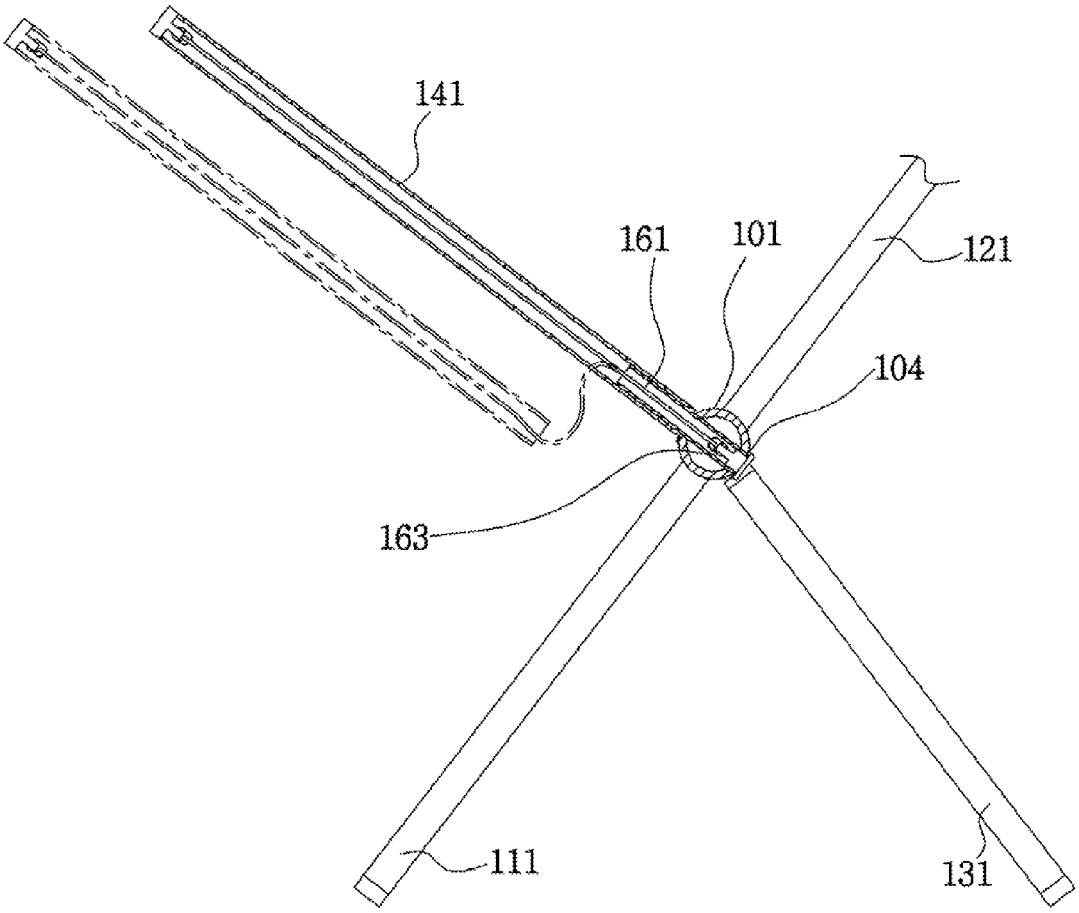
FIG. 5 is a partial cross-sectional view showing a coupled state of a seat support pole of the collapsible chair according to another embodiment of the present invention.

FIG. 4 is a partial cross-sectional view showing a coupled state of a rear support pole of a collapsible chair according to another embodiment of the present invention, and FIG. 5 is a partial cross-sectional view showing a coupled state of a seat support pole of the collapsible chair according to another embodiment of the present invention.

The embodiment described with reference to FIGS. 1 to 3 illustrates a configuration in which the insert part 132 of the rear support poles 131 which is inserted into the first insertion holes 103 of the main body 101 and the insert part 142 of the seat support poles 141 which is inserted into the second insertion holes 104 of the main body 101 are connected by the elastic cables 161. On the other hand, this embodiment employs a configuration in which a first fixing cap 162 and a second fixing cap 163 are inserted into the first and second insertion holes 103 and 104, and are fixed by adhesives or the like, respectively.

The first fixing cap 162, which is inserted into the first insertion holes 103 of the main body 101, is connected to the insert part 132 of the rear support poles 131 by the elastic cable 161. In addition, the second fixing cap 163, which is inserted into the second insertion holes 104 of the main body 101, is connected to the insert part 142 of the seat support pole 141 by the elastic cable 161.

Therefore, since the upper ends of the rear support pole 131 and the seat support pole 141 are connected with the first and second caps 162 and 163 whose one end is inserted in the first and second insertion holes 103 and 104 of the main body 101 and the other end thereof is exposed to the outside, theses poles 131 and 141 may be easily attached and detached.

According to the collapsible chair for leisure of the present invention, since the coupling holes, the first and second insertion holes are formed on the opposite end portions of one main body at the predetermined angles different from each other, and the front and rear support poles, the seat back poles and the seat support poles may be inserted into the above holes, it is possible to easily install and fold the chair in the field.

In addition, according to the collapsible chair for leisure of the present invention, since the coupling holes, the first and second insertion holes are formed on the opposite end portions of one main body at the predetermined angles different from each other, it is unnecessary an additional member for connecting the poles to the main body. Moreover, it is possible to save resources with a simple configuration, have no risk of breakdown, and make the chair with a reduced weight.

Further, according to the collapsible chair for leisure of the present invention, since the seat back poles has the bent portion which is formed in the middle section thereof at a predetermined angle, the load of the user is absorbed by the bent portion of the seat back poles, while elastically support the back of the user. Thereby, it is possible to provide a seating sensation with relaxed and improved comfortableness.

Furthermore, according to the collapsible chair for leisure of the present invention, since the seat has a headrest embedded in the upper end portion thereof adjacent to a tip end of the seat back pole, when a user sits on the seat, it is possible to prevent the top of the seat from being folded as both seat back poles are retracted inward, and improve convenience by providing the headrest function.

While the present invention has been described with reference to the preferred embodiments, it will be understood by those skilled in the related art that various modifications and variations may be made therein without departing from the scope of the present invention as defined by the appended claims.

What is claimed is:

1. A collapsible chair for leisure, the chair comprising:

a main body comprising:

a pair of first coupling holes each formed on each end portion of the main body and on a first surface of the each end portion;

a pair of second coupling holes each formed on the each end portion of the main body and on a second surface of the each end portion, the second surface opposite to the first surface on which the first coupling hole is formed, and having a first predetermined angle with respect to the pair of first coupling holes;

a pair of first insertion holes each formed at a first predetermined distance from a corresponding first coupling hole toward a center of the main body, and having a second predetermined angle with respect to the pair of first coupling holes; and a pair of second insertion holes each formed at a second predetermined distance from a corresponding first insertion hole toward the center of the main body, and having a third predetermined angle with respect to the pair of first insertion holes;

a pair of front support poles each comprising:

a first end inserted into one of the pair of first coupling holes and one of the pair of second coupling holes of the main body through a first telescopic insert part of the each front support pole, and a second end supported on ground;

a pair of seat back poles each comprising:

a first end coupled with the first telescopic insert part of a corresponding front support pole;

a pair of rear support poles each comprising:

a first end inserted into a corresponding first insertion hole of the main body through a second telescopic insert part of the each rear support pole, and a second end configured to be supported on the ground;

a pair of seat support poles each comprising:

a first end inserted into a corresponding second insertion hole of the main body through a third telescopic insert part of the each seat support pole; and a seat comprising:

upper and lower end portions fixed by second ends of the pair of seat back poles and second ends of the pair of seat support poles, through first and second insert parts formed at the upper and lower end portions of the seat, respectively, wherein the seat is supported by the pair of seat support poles and the pair of seat back poles at four corners thereof.

2. The collapsible chair for leisure according to claim 1, wherein each of the seat back pole further comprises:

a bent portion formed in a middle section of the each seat back pole, the bent portion has a predetermined angle with respect to the main body so as to absorb a load of a user applied to the each seat back pole through the seat.

3. The collapsible chair for leisure according to claim 1, wherein the seat further comprises a headrest which is embedded in the upper end portion of the seat, the headrest is adjacent to the second ends of the seat back poles so as to prevent a top of the seat from being folded as the seat back poles are retracted inward by a load of a user sitting on the seat.

4. The collapsible chair for leisure according to claim 1, wherein one of the pair front support poles and one of the pair of seat back poles are connected with each other by a first elastic cable inserted in one of the pair of first coupling holes and one of the pair of second coupling holes, and wherein one of the pair of rear support poles and one of the pair of seat support poles are connected with each other by a second elastic cable inserted in the one of the pair of first insertion holes and one of the pair of second insertion holes.

5. The collapsible chair for leisure according to claim 4, further comprising:

a first cap connected with the second telescopic insert part of the rear support pole which is inserted in the one of the pair of first insertion holes of the main body by the first elastic cable; and a second cap connected with the third telescopic insert part of the seat support pole which is inserted in the one of the pair of second insertion holes of the main body by the second elastic cable.

* * * * *